United States Patent [19]

Hall

[11] 4,075,711

[45] Feb. 21, 1978

[54] CONCRETE MIXING SYSTEM

[75] Inventor: Jack F. Hall, Portland, Oreg.

[73] Assignee: U-Cart Concrete Systems, Inc., Vancouver, Wash.

[21] Appl. No.: 749,042

[22] Filed: Dec. 9, 1976

[51] Int. Cl.[2] ..... B28C 5/14

[52] U.S. Cl. ..... 366/26; 366/64; 366/68

[58] Field of Search ..... 259/160, 161, 159 A, 259/162, 169, 170, 173, 178 R, 178 A, 174, 72, 9, 10, 25, 26, 45, 46, 164, 109, 110

[56] References Cited

U.S. PATENT DOCUMENTS

| | | | |
|---|---|---|---|
| 2,705,134 | 3/1955 | Jerner | 259/160 |
| 2,815,195 | 12/1957 | Bolt | 259/160 |
| 2,940,739 | 6/1960 | Shindeldecker | 259/160 |
| 3,100,064 | 8/1963 | Kacena | 259/160 |
| 3,148,867 | 9/1964 | August | 259/160 |

*Primary Examiner*—Robert W. Jenkins
*Attorney, Agent, or Firm*—Chernoff & Vilhauer

[57] ABSTRACT

An upright concrete mixing chamber having an inlet formed in the top thereof and an outlet formed in the bottom thereof is supported in a lowered position upon a horizontal working surface so as to provide operator access to the inlet when the operator is standing upon the working surface. A plurality of elongate members are pivotably connected at one end to a base member in engagement with the working surface, and at the other end are pivotably connected to the mixing chamber so as to define a parallelogram that is generally horizontal to the working surface when the mixing chamber is in the lowered position. A hinged lifting apparatus is provided for pivoting the elongate parallelogram members from the horizontal position to a second position generally perpendicular to the working surface and thereby elevating the mixing chamber to a raised upright discharge position a sufficient distance above the working surface to permit movement of a cement transport device beneath the outlet for receiving a discharge of concrete mixture therefrom. The mixing system further includes a motor for providing continuous rotary motion to blending paddles mounted in the mixing chamber, and selectively engageable means for coupling the motor to the hinged lifting apparatus to thereby cause the hinged members thereof to articulate and raise the mixing chamber to its raised upright discharge position.

4 Claims, 4 Drawing Figures

FIG. 1
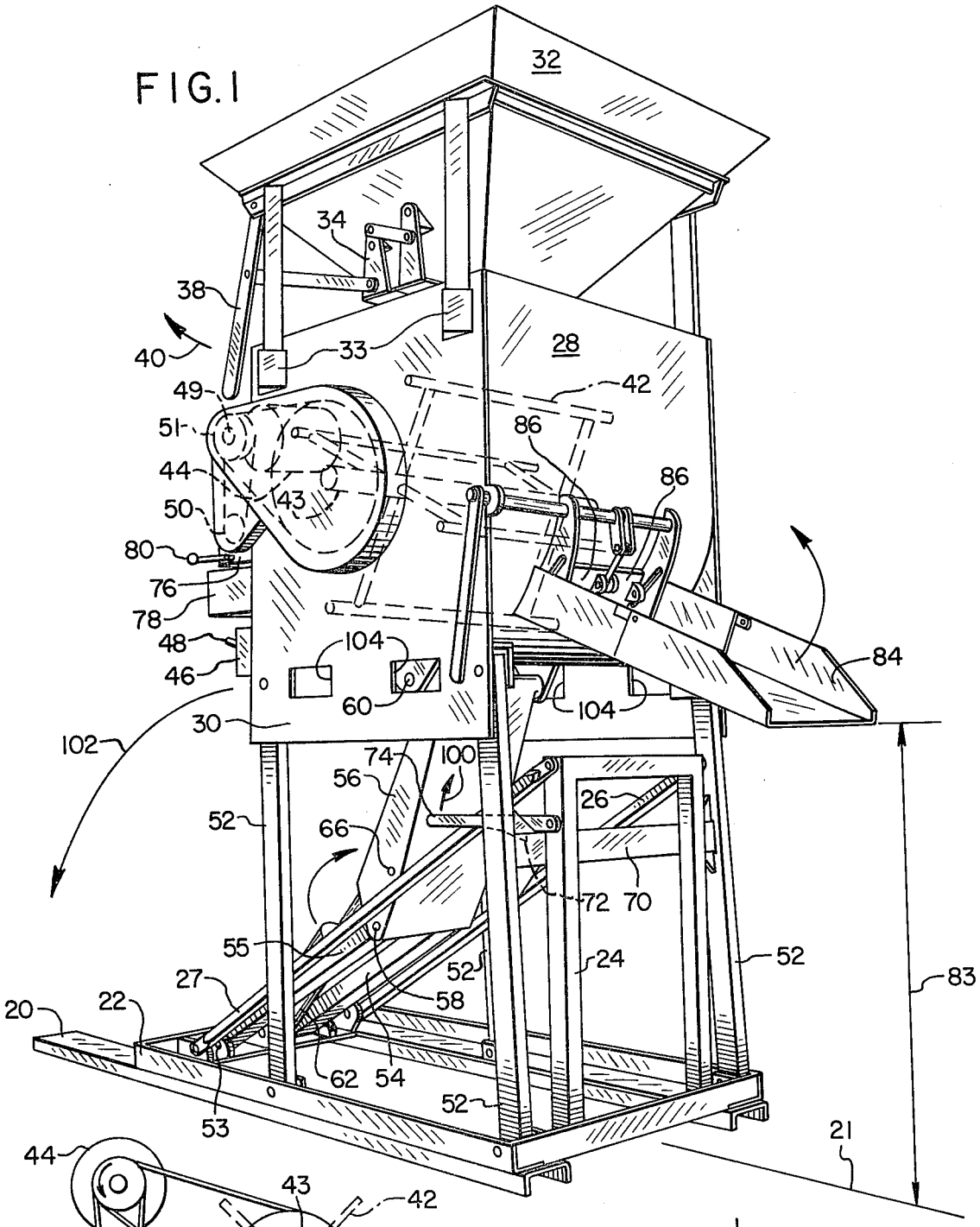
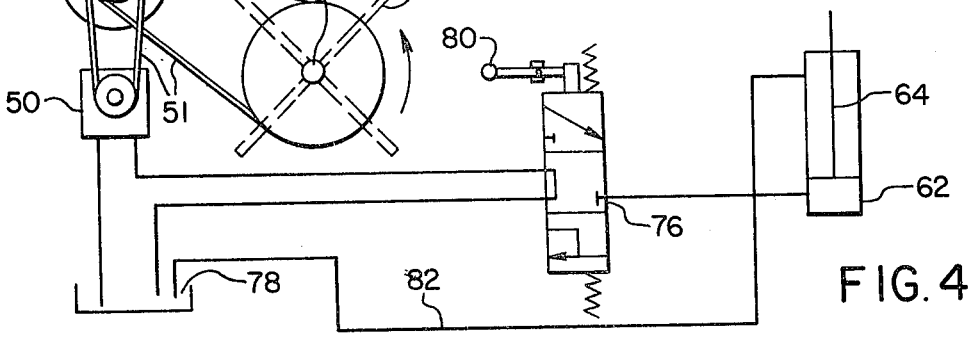
FIG. 4

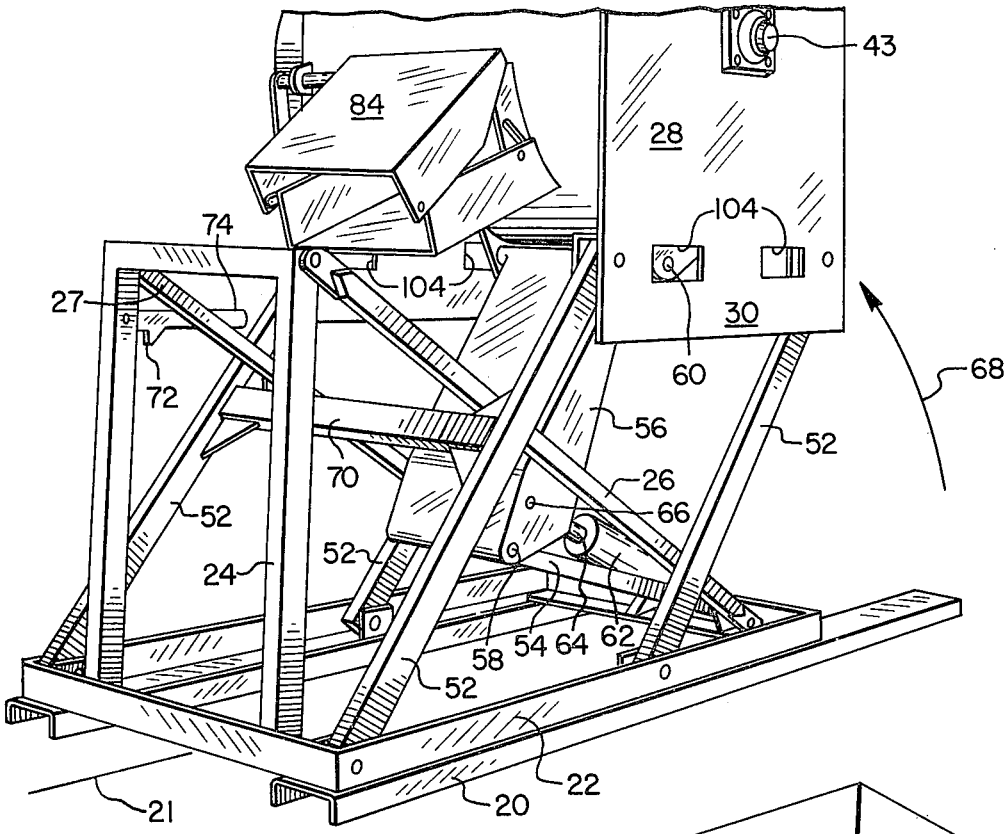
FIG. 2
FIG. 3
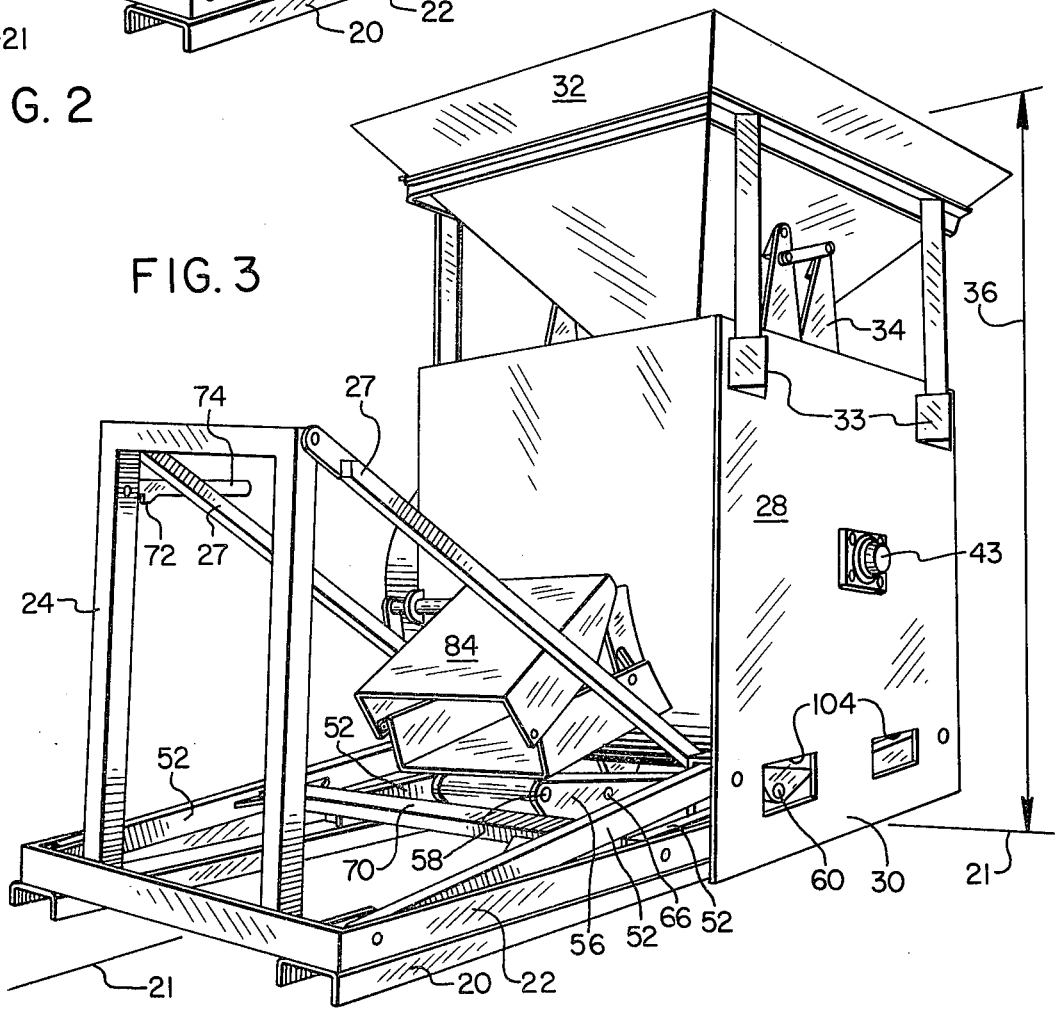

CONCRETE MIXING SYSTEM

BACKGROUND OF THE INVENTION

The present invention relates to a concrete mixing system, and more particularly relates to improvements in large portable concrete mixing systems having a mixing capacity greater than 20 cubic feet and embodying an upright mixing chamber having an inlet in the top thereof for permitting the introduction of mixture materials and an oulet at the bottom thereof for selectively permitting the discharge of a wet concrete mixture. This general type of mixer is particularly exemplified by that shown in Hall U.S. Pat. No. 3,759,492.

The features of such upright portable concrete mixing systems must resolve several factors, which inherently flow out of the competing considerations of portability and capacity, such as efficiency, installation time, cleanup time, space requirements, ease of operator access, and ease of delivery of the wet concrete mixture to transport devices.

Previous portable concrete mixers having their concrete mix materials inlet at a sufficiently low elevation to permit easy operator access thereto either sacrifice system capacity or have their concrete discharge outlet at a very low elevation with respect to the working surface. In the latter instance, such a system inevitably complicates the process of discharging the wet concrete mixture into transport devices such as trucks, carts and the like, since the low elevation of the outlet precludes the movement of transport devices upon the working surface to a position beneath the outlet. Accordingly, such systems require complex means such as conveyor belts for delivering the concrete mixture to concrete transport devices. Such delivery devices inherently require an inordinate amount of installation time, cleanup time and working space and thereby limit the mobility and efficiency of the mixing system.

Conversely, previous concrete mixing systems having their discharge outlet sufficiently spaced above a horizontal working surface as to permit the movement of transport devices upon the working surface to a position beneath the discharge outlet, either sacrifice system capacity or have their inlet spaced so far above the working surface as to preclude an operator standing upon the working surface from introducing concrete mix materials thereto. The latter systems require the time-consuming erection of a working platform to permit operator access to the mixer inlet, and/or some form of bulky elevator to raise the mixing materials to the level of the inlet.

What is needed, therefore, and what the present invention provides, is a portable upright concrete mixer having a relatively large capacity that is compact, has an inlet for introducing mixing materials located sufficiently proximate a working surface to permit easy operator access thereto, has a discharge outlet sufficiently above the working surface as to permit movement of transport devices on the working surface to a position below the outlet, and which provides enhanced portability by requiring a minimum of installation, cleanup and transport efforts.

SUMMARY OF THE INVENTION

The present invention relates to improvements in portable concrete mixing systems and is particularly directed to upright concrete mixing systems having a loading inlet at the top and a discharge outlet at the bottom thereof.

An object of the present invention is to provide a portable concrete mixing system that is compact without thereby lowering the mixing capacity. The preferred embodiment of the present invention provides a mixing capacity of up to twenty seven cubic feet while requiring less than 50 percent of the working surface required by comparable mixers.

Another objective of the present invention is to provide operator access to a top-loading inlet without thereby necessitating the erection and cleanup of a loading platform or load elevator. The preferred embodiment of the present invention includes means for supporting the mixing chamber sufficiently proximate a horizontal working surface as to permit an operator standing upon that working surface to have ready access to the top-loading inlet thereof.

Another objective of the present invention is to eliminate the need for a conveyor to hoist the concrete mixture discharged from the bottom of the mixing chamber to the height of a mixture transport device while simultaneously eliminating the cleanup time and installation labor required for such conveyors. The preferred embodiment of the present invention provides a discharge outlet located sufficiently above a horizontal working surface so as to permit the movement of transport devices upon the working surface to a position beneath the discharge outlet.

A primary feature of the present invention is to provide a lifting apparatus for selectively raising the upright concrete mixing chamber from a lowered loading position to a raised discharge position. In the preferred embodiment of the present invention an integral lifting apparatus is provided which allows the mixing assembly to be raised above the working surface without necessitating an elevator pit therefor.

Another feature of the present invention is to provide a drive means for providing continuous rotary motion for a blender within the mixing chamber, which is selectively engageable to the lifting apparatus thereby also providing lifting power. In the preferred embodiment of the present invention an electric motor is capable of simultaneously providing rotary force to the blending paddles and to a hydraulic pump. A manually controllable valve is provided for selectively pumping hydraulic fluid under pressure to a lifting cylinder or relieving the pressure, thereby raising or lowering the lifting apparatus.

Yet another feature of the present invention is to provide a lifting apparatus which maintains the mixing chamber in an upright orientation throughout the lifting process in order to prevent mixture spillage therefrom. In the preferred embodiment of the present invention an integral hinged parallelogram lifting assembly raises the mixing chamber to a discharge position without thereby tilting the chamber.

A further feature of the present invention is to releasably lock the mixing chamber in its raised position to insure against accidental lowering of the mixing chamber. In the preferred embodiment of the present invention a mechanical latch is provided which releasably locks the parallelogram lifting assembly when the mixing chamber is in its raised discharge position and thereby prevents any downward movement of the mixing chamber.

A further feature of the present invention is to provide an adjustable outlet chute for discharging the wet concrete mixture from the mixing chamber at a plurality of elevations above the working surface and at a plurality of distances spaced from the mixing chamber. In the preferred embodiment of the present invention a foldable discharge chute is provided which can be used to discharge the wet concrete mixture from the mixing chamber in either a folded or extended form thereof.

Further features and advantages of the present invention will become apparent and the full nature of the invention will be more readily understood from the accompanying drawings and the following description and claims.

BRIEF DESCRIPTION OF THE DRAWINGS

FIG. 1 is a perspective view of the preferred embodiment of the present concrete mixing system with the mixing chamber elevated to its raised discharge position.

FIG. 2 is a perspective view of the preferred embodiment of the present concrete mixing system with the mixing chamber elevated partially toward its raised discharge position and showing the maintenance of an upright orientation of the mixing chamber throughout the lifting process.

FIG. 3 is a perspective view of the preferred embodiment of the present concrete mixing system with the mixing chamber being supported in a lowered position proximate the working surface to provide operator access to a detachable input hopper.

FIG. 4 is a schematic diagram of an exemplary hydraulic power circuit for operating the lifting apparatus and shows an electric motor providing continuous rotary motion to the blending drive shaft and to a hydraulic pump.

DETAILED DESCRIPTION OF THE INVENTION

With particular reference to FIG. 1, a preferred embodiment of the invention is set forth wherein 20 is a horizontal base member in engagement with a horizontal working surface indicated generally as 21. A rectangular frame member 22 is horizontally mounted on the base member 20.

An upright member 24 is rigidly mounted on the front end of the frame member 22 and extends perpendicularly therefrom. The upright member 24 receives bracing support from a pair of diagonal arms 26 and 27 which are connected at one end to the top thereof and at the other end to the rear of the frame member 22.

Referring now also to FIG. 3, a mixing chamber 28 has a support member 30 extending down from both sides thereof for supporting the mixing chamber in a lowered position at a first predetermined distance above the horizontal working surface 21. A detachable input hopper 32 is mounted on the top of the mixing chamber 28 and has a conventional pivotable inlet 34 mounted on the bottom thereof for selectively introducing concrete mix materials into the mixing chamber 28. The pivotable inlet 34 can be pivoted to a plurality of open positions by moving lever 38 in the direction indicated by arrow 40. As is generally indicated by a dimensional arrow 36 (FIG. 3), the top of the input hopper 32 is sufficiently proximate the working surface 21 when the mixing chamber is in the lowered position as to permit an operator standing upon the working surface to introduce concrete mix materials into the mixing chamber 28 via the input hopper 32.

It should be noted that the input hopper 32 is detachably mounted by sleeves 33 to the mixing chamber 28, which permits its removal prior to the elevation of the mixing chamber 28 and thereby permits the mixer to be operated at site locations which impose vertical height restraints.

A foldable discharge chute 84 is mounted on the bottom front surface of the mixing chamber proximate a discharge door 86. The chute 84 is shown in its fully extended position in FIG. 1 and is used to conduct the wet concrete mixture from the mixing chamber 28 to a transport device such as a truck, trailer or the like positioned thereunder upon the working surface 21. As is best seen in FIG. 1, the fully extended discharge chute 84 conducts the concrete mixture to a predetermined height 83 above the working surface 21 and a predetermined distance spaced from the front surface of the mixing chamber so as to discharge the mixture into a transport device having a complementary height and width.

The chute 84 is shown in its folded position in FIGS. 2–3 and it will be seen therefrom that the folded chute has a suitable opening formed therein that permits gravitational discharge of the wet concrete mixture therethrough at a different height above the working surface 21 and at a different distance spaced from the front surface of the mixing chamber 28. This feature permits the discharge chute to be varied to accommodate transport devices having varying heights and widths.

Hence, when the mixing chamber 28 is in its lowered position, as shown in FIG. 3, an operator standing upon the working surface 21 can easily load concrete mixing materials manually into the input hopper 32 and thereafter use lever 38 to introduce a predetermined amount of the materials into the mixing chamber 28. It is important to note that the operator has free access to the input hopper while standing upon the horizontal working surface without any requirement for a loading platform or elevator for hoisting the mix materials to the inlet.

As is best seen in FIG. 1, a plurality of blending paddles 42 are mounted in the mixing chamber 28 on a drive shaft 43 for rotary motion therewith. An electric motor 44 (shown in phantom) is mounted on the back of the mixing chamber 28. An external power source can be connected to the motor 44 via a receptacle box 46 and a switch 48 to energize the motor and provide continuous rotary motion through reduction gearing 49 and drive belts 51 to the drive shaft 43 and thereby cause the blending paddles 42 to rotate within the mixing chamber 28. A liquid and dry concrete mix materials can be introduced into the mixing chamber 28 where they will be blended by the rotary action of the blending paddles 42 and thereby provide a wet concrete mixture.

The blending paddles 42 are shown for purposes of clarity as being rotated around a horizontal axis. It will be understood, however, that the blending paddles 42 may alternatively be rotated about an axis perpendicular to the top and bottom of the mixing chamber 28 and include a flexible portion in contact with the sides of the mixing chamber so as to sweep away any mix materials adhering to the mixing chamber surfaces and insure that the mix materials will be thoroughly blended with the liquid.

Still referring to FIG. 1, the electric motor 44, when energized, also provides continuous rotary motion through the reduction gearing 49 and drive belts 51 to a hydraulic pump 50 (shown partially) for reasons hereinafter described.

A plurality of elongate members 52 are pivotably mounted at one end to the rectangular frame 22 and at their other ends are pivotably mounted to the bottom of the mixing chamber 28 so as to form a parallelogram that is generally horizontal when the mixing chamber is in its lowered position as shown in FIG. 3, and generally vertical when the mixing chamber is in its raised position as shown in FIG. 1. A pair of fore-and-aft arms 54 and 55 (best seen in FIGS. 1 and 2) spaced inwardly of diagonal arms 26 and 27 are pivotably connected at their lower ends to the rear of the frame member 22 by a pivot link 53 (FIG. 1) and are pivotably connected at their upper ends to the lowest and most forward portion of a lever arm 56 by means of a second pivot link 58. The upper end of the lever arm 56 is pivotably connected to the bottom of the mixing chamber 28 by a third pivot link 60.

A cylinder 62 is pivotably connected to the rear of the frame member 22 at the pivot link 53 and houses therein a piston having a piston rod 64. The upper end of the piston rod 64 is pivotably connected to the lever arm 56 by a fourth pivot link 66 offset from the second pivot link 58.

When the piston rod 64 is forced forwardly, it will cause the lever arm 56 to hingedly move upwardly from its folded association with the fore-and-aft arms 54 and 55 and thereby force the mixing chamber 28 to move in the direction shown by arrow 68 in FIG. 2. This lifting action will also cause the elongate members 52 to pivot from their first generally horizontal position (as shown in FIG. 3) to a second generally vertical position (as shown in FIG. 1) to support the mixing chamber 28 in its raised upright discharge position. It will be seen that this translational-type lifting by pivoting the elongate members 52 concurrently with the lifting of the mixing chamber 28 maintains the mixing chamber in an upright orientation throughout the raising cycle and thereby, in addition to providing a highly efficient lifting mechanism which does not require an elevator pit, precludes tilting of the mixing chamber 28 and prevents spillage of the wet concrete mixture throughout the raising cycle.

The two forward elongate members 52 (best shown in FIGS. 1 and 2) have a cross bar 70 integral thereto. A latching arm 74 extends pivotably outward from the upright member 24 and has a downwardly projecting dog 72 disposed thereon for engagement with the cross bar 70 so as to releasably lock the elongate members 52 as indicated in FIG. 1 when the elongate members have been pivoted to their vertical position. This feature prevents accidental lowering of the mixing chamber 28 from its raised upright discharge position and thereby guards against injury to the operator should there be a failure of the lifting mechanism.

Referring generally to FIG. 1, and more particularly to the schematic view provided by FIG. 4, a three-position valve 76 is mounted on the back surface of the mixing chamber 28 and serves, in its neutral position, to receive hydraulic fluid being pumped thereto from the reservoir 78 by the continuous pumping action of the hydraulic pump 50 and to recycle this fluid back to the reservoir 78. The three-position valve 76 therefore permits the continuously activated motor 44 to simultaneously provide rotary motion to both the hydraulic pump 50 and the blending paddles 42. However, when the lift actuator arm 80 of the three-position valve 76 is moved in one direction from its neutral position, the three-position valve will permit the hydraulic pump 50 to pump the hydraulic fluid therethrough to the bottom portion of the cylinder 62 forcing the piston to travel upwardly and thereby raise the mixing chamber 28 from its lowered position shown in FIG. 3 to its raised discharge position shown in FIG. 1. The upward movement of the piston will also cause any fluid trapped in the upper end of the cylinder 62 to be returned to the reservoir 78 via a bleed hose 82, and will pivot the elongate members 52 from their horizontal positions to their vertical positions.

In this regard, it should also be noted that the three-position valve could be manipulated to raise and hold the mixing chamber 28 at any of a plurality of heights between its lowered mixing position and its raised discharge position to further accommodate varying forms of concrete mixture delivery devices. In such case, additional folding chute elements, flexible units, or telescoping units could be added to the discharge chute 84 in order to further increase the flexibility of the discharge mechanism.

When the discharge has been completed, the locking mechanism for the elongate members 52 can be released by moving the latching arm 74 in the direction indicated by arrow 100 (FIG. 1). Thereafter, as best seen in FIG. 4, the lift actuator arm 80 can move the valve 76 in the opposite direction from the neutral position to allow the weight of the mixer to force the hydraulic fluid to return from the cylinder 62 to the reservoir 78. Referring to FIG. 1, this bleeding action enables the piston rod 64 to retract toward the rear of the cylinder 62 causing the lever arm 56 to hingedly move downward towards a folded position with respect to the fore-and-aft arms 54 and 55 and thereby pivot the elongate members 52 and the mixing chamber 28 in the direction indicated by arrow 102 (FIG. 1).

As the elongate members 52 begin to pivot downwardly, the impingement of the foldable chute 84 with the upright member 24 causes the foldable discharge chute 52 to return to its folded position. When the mixing chamber 28 has been sufficiently lowered from its discharge position to enable its support members 30 to engage the working surface 21, the lift actuator arm 80 is returned to its neutral position thereby completing the lowering process. At this time, fluid pumped to the three-position valve 76 will be recycled back to the reservoir 78 in a recirculating fashion.

It should be noted that a pair of rectangular slots referred to generally as 104 are formed in the support members 30. The walls forming the slots 104 are of sufficient strength and configuration as to permit the tines of a forklift to extend therethrough and to raise the entire concrete mixing system for transportation to alternate work sites and, hence, this feature further enhances the mobility of the portable concrete mixing system. It should be further noted that these slots eliminate the need for a support pallet and thereby, in addition to enhancing mobility, permit the mixing chamber to be supported more proximate the working surface 21 than would be possible if a support pallet was required.

The terms and expressions which have been employed in the foregoing abstract and specification are used therein as terms of description and not of limitation, and there is no intention in the use of such terms and expressions, of excluding equivalents of the features shown and described or portions thereof, it being recognized that the scope of the invention is defined and limited only by the claims which follow.

I claim:

1. An apparatus for mixing concrete, comprising:

(a) an upright mixing chamber having a top and bottom;

(b) inlet means, having a top, attached to said mixing chamber for permitting the introduction of concrete mix materials into said mixing chamber;

(c) mixing means within said mixing chamber for blendingly combining said mix materials with one another so as to form a concrete mixture in said mixing chamber;

(d) outlet means proximate the bottom of said mixing chamber for selectively discharging said concrete mixture from said mixing chamber;

(e) support means connected to said mixing chamber for engaging a horizontal working surface and supporting said mixing chamber in a lowered upright position with the bottom thereof at a first predetermined distance above said working surface to facilitate access to said inlet means; and (f) lifting means connected to said mixing chamber for selectively raising said mixing chamber to a raised upright position, with the bottom thereof at a second predetermined distance above said working surface greater than said first predetermined distance, so as to provide sufficient clearance between the bottom of said mixing chamber and said working surface to permit movement of a concrete mixture transport device to a position on said working surface beneath said outlet means, said lifting means comprising a plurality of members movable with respect to one another in such a manner that such plurality of members push upwardly against said mixing chamber during such movement, means for energizing said members, and means for continuously maintaining said upright mixing chamber in upright orientation during said lifting and said discharging.

2. The apparatus of claim 1, wherein said mixing means includes drive means for providing continuous motion to said mixing means, further including means for selectively coupling said drive means to said lifting means to thereby provide power to said lifting means to raise said mixing chamber.

3. The apparatus of claim 1, wherein said outlet means includes means defining an aperture proximate said bottom of said mixing chamber, a discharge door positionable so as to extend across said aperture, means for selectively positioning said door in a plurality of positions to variably control the area of said aperture, means for urging said concrete mixture from said mixing chamber through said aperture, and means mounted at one end thereof upon said mixing chamber for conducting said concrete mixture from said aperture to said transport device, said conducting means being laterally extensible and vertically adjustable relative to said mixing chamber so as to dispense said concrete mixture at a plurality of heights above said working surface and at a plurality of distances from said mixing chamber thereby facilitating the use of various forms of transport devices.

4. The apparatus of claim 1 wherein none of said plurality of members extend higher than the top of said inlet means when said mixing chamber is in said lowered upright position.

* * * * *

UNITED STATES PATENT AND TRADEMARK OFFICE

CERTIFICATE OF CORRECTION

PATENT NO. : 4,075,711

DATED : February 21, 1978

INVENTOR(S) : Jack F. Hall

It is certified that error appears in the above-identified patent and that said Letters Patent are hereby corrected as shown below:

Col. 4, Line 8 After "chamber" insert the number --28--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*